US005678283A

United States Patent [19]

Zierer

[11] Patent Number: 5,678,283

[45] Date of Patent: Oct. 21, 1997

[54] BELT WITH CLASP ASSEMBLY

[76] Inventor: Hermann Zierer, A-4600 Wels, Trauneggsiedlung 4, Thalheim, Austria

[21] Appl. No.: 621,836

[22] Filed: Mar. 26, 1996

[30] Foreign Application Priority Data

Mar. 31, 1995 [AT] Austria ..... 579/95

[51] Int. Cl.[6] ..... A44B 11/06

[52] U.S. Cl. ..... 24/308; 24/168; 24/265 BC

[58] Field of Search ..... 24/265 R, 265 BC, 24/163 R, 168, 309, 308, 31 R, 33 R, 33 P, 33 B, 37, 20 LS, 31 C

[56] References Cited

U.S. PATENT DOCUMENTS 3,818,548 6/1974 Meyerson .

OTHER PUBLICATIONS

International Publication No. WO 89/01746 to W. Weeks et al. entitled "Strap Fastener," dated 9 Mar. 1989.

*Primary Examiner*—James R. Brittain

*Attorney, Agent, or Firm*—Watson Cole Stevens Davis, P.L.L.C.

[57] ABSTRACT

A belt is fastened to a clasp on one end and locked with its other end in various positions in the clasp. The clasp defines a gap between two parallel walls into which one end of the belt is inserted and is fastened or locked in the gap by at least one screw which presses the belt against a wall of the gap which is opposite to the screw.

6 Claims, 3 Drawing Sheets

BELT WITH CLASP ASSEMBLY

BACKGROUND OF THE INVENTION

1. Field of the Invention

This invention relates to a belt clasp assembly in which one end of a belt is fastened and the other end can be locked in various positions, wherein at least one of the ends of the belt can be inserted into a gap formed from at least two opposite walls provided on the clasp assembly and can be pressed by a clamping device, which is supported on the clasp assembly on one side of the gap, onto the wall of the slot opposite to the clamping device.

2. The Prior Art

The majority of conventional belts are usually provided with buckles to which one end of the belt is fastened, mainly by a loop of the belt which is looped around a crossbar of the buckle. The other end of the belt is inserted into the buckle and is provided with a number of holes, one of which is taken up by a pin of the buckle, whereby the belt is locked. It is difficult with this arrangement to change the length of the belt as necessary. If the end of the belt is fastened to the buckle by a loop, the belt cannot be easily shortened at that point since the loop requires a particular design for the end of the belt. Shortening the belt by cutting a portion thereof on the other end with the holes is also practically impossible, since then an unappealing end of the belt results and multilayered belts can experience loosening of the layers.

To fasten the belt to the buckle, a connector in the form of a housing is also known. This housing forms an open gap on one side into which the end of the belt can be inserted. Subsequently, the belt end is fixedly held in the gap. Screws are provided which pass through the connector and the belt. The belt can tear out of the screws in this case. Shortening and refastening of the belt in the gap using screws is difficult, since on one hand the screws can be bent, and on the other hand the holes in the end of the belt for the screws must be placed in exactly the correct positions.

A belt with a clasp of the above-mentioned design is disclosed in U.S. Pat. No. 3,818,548, which belt is provided with a clamping device to fasten the belt in a channel gap taking up the belt. This clamping device consists of a wall inside the clasp which can be pressed against the belt. A clamping segment is mounted on this wall which is supported by a wedge shaped surface against a stationary bolt within the clasp. The entire arrangement is covered on the outside by a tiltable cover. The clamping segment can be twisted after opening the cover, whereby it presses the wall onto the belt using the wedge-shaped surface and thus fasten the belt against the solid wall of the gap located on its other side. This well-known clamping device consists of a quite a lot of parts and is correspondingly complicated and expensive to produce. It is also awkward to use and stiff based on the friction of the wedge-shaped surface.

In further known designs, the belt end is fastened with the help of a connector on the clasp, one wall of which, or a large portion thereof, is designed as a lid tilted about a perpendicular axis and which is provided with a shank near the axis bent approximately 90 degrees against the belt which has a series of sharp spikes on the front side. The end of the belt is inserted into the gap of the connector when the lid is opened and the lid is then closed. The shank with the spikes presses into the belt and anchors it thusly to the connector. The belt is damaged by the sharp spikes at least on its surface. If the belt consists of many layers, the spikes will press into only the so-called outer layer, which can rip out at heavier loads. Besides this, the lid with the spikes is complicated and can be easily bent, resulting in loss of the locking effect.

Finally, belts are known with a belt-lock in which the belt, consisting mainly of a woven textile, is locked in place by a clamp. One end of the belt is fastened to the belt-lock and the other end is inserted into a split channel which extends through the belt-lock. A rod is mounted in slots which are at an angle to the length of the belt in this channel perpendicular to the belt which penetrates the slot outwardly and whose end outside the belt-lock can be shifted along the length of the belt. By shifting, the rod approaches or recedes from the belt, depending on the direction in which it is displaced. The end of the belt can be inserted unhindered into the channel of the belt-lock when the rod is extended form the belt. When the rod is slid into the slot against the belt, it clamps the belt tightly. The belt must be tensioned constantly in order to maintain the lock. If the tension of the belt slackens and the belt is shoved into the belt-lock, the rod also slides in the slots directing it whereby the clamping effect ceases. It is therefore impossible to lock a belt with such a belt-lock in a relatively loose position.

A similar working belt locking system, which is used as a packing means to fasten a belt or strap laid around a package, is well-known from WO 89/01746 A1. This belt-locking system has one or more 90 degree slots which are provided with perpendicularly traveling locking rolls operating on tilted surfaces. The ends of the belts can be inserted unhindered into the slots in one direction, whereas the belts are locked by the locking rolls when moved in the opposite direction. The choice of loosening the clamping device is thus not provided, which is why this well-known belt-locking system is not suitable for small belts.

The objective of simplifying the belts with clasps used in the past, as well as improving them in function, quality and appearance, is the object of this invention.

SUMMARY OF THE INVENTION

This object is accomplished with the invention in belts with clasps as described above in that the clamping device consists of at least one screw which is supported on one wall of the gap and which can be displaced toward the belt from the outside of the clasp by rotating. It thus fastens the belt against the opposite wall of the slot with its leading side. The locking of the belt is accomplished simply by fastening the belt using one or more screws without damaging the belt itself or its outer skin. There is merely a compression of the belt, wherein parts of the screw can press into the material and leave behind pressure traces. The belt itself remains undamaged, however. No holes are necessary for uptake of the screws and no damaging of the outer skin of the belt by gripping spikes or edges arises in the fastening of the belt to the clasp. A single screw with a large diameter is all that is needed for anchoring of the belt. This screw can be provided with a relatively broad operating slot so that it can be turned with the help of a coin. Another particular advantage arises in that the clamping device can compensate for varying tensions on the belt, so that the same clasp design can be used for various belt tensions.

The clasp can be provided with a connector to fasten one end of the belt which has the walls with the clamping device forming the gap, which envelops the end of the belt around its circumference on all sides and which is provided with at least one screw for fastening of the belt. The end of the belt is then simply inserted into the connector and fastened with the screw. This has the advantage that the length of the belt can be easily adjusted as required. The belt can be shortened as desired at the end fastened in the connector and then again be easily fastened to the connector.

The connector can be solidly, e.g., rigidly, fastened to the clasp. The clasp can have any desired well known design. It can, for example, be a buckle with spoke, a clasp with a clamping device or any other belt lock. In order to achieve a larger degree of movement of the belt near the clasp, the connector can be tiltably connected to the clasp using a hinge, which can be of any type.

In a preferred design of the invention, the clasp as well as the connector each have a gap with at least one screw for fastening the belt. The advantages resulting from the clamping device according to the invention can be utilized for fastening of both ends of the belt, indeed for the clasp as well as for the connector.

A protruding circular surface can be provided on the leading edge of the screws of the clamping device according to the invention, which can be pressed into the material of the belt by the screw. Anchoring the belt is thus improved with screws which are less tight. In order to further increase the clamping effect, the wall opposite the screws of the gap can be roughened. A set screw is the most sufficient for satisfactory fastening. Two or more screws can also be provided in the clasp or connector, however.

In another manifestation of the invention, a dial accessible on the outside of the clasp can be provided for screw operation. The screw can be screwed into a limiting wall of the housing of the clasp facing the broad side of the belt, acting on the belt with its interior edge and connected to the dial at its outer end. The free end of the belt is locked in the clasp using a screw in the same way that the other end is locked in the connector.

Another simple design of the belt clasp is possible according to the invention in that a circular dial is provided to operate the screw which protrudes laterally over the housing of the clasp with its edge and which has a threading on its inner perimeter into which a pressure ring is screwed which is displaced axially and non-rotationally with its inner edge along a guide ring. The guide ring is fastened to the housing, preferably with at least one screw, and the pressure ring can be displaced towards the belt by turning the dial. This deals with a relatively simple clamping device which is easy to activate and is suited for construction in a largely closed housing so that the clasp can be designed with an attractive appearance.

In another design of the invention, the screw has a dial which is provided with a threaded shaft on whose free end a clamping ring is threaded which does not turn but can be axially shifted, which can be displaced against the belt by turning the dial. The design is also relatively simple in construction and advantageous to use. The dial can be arranged fixed in the housing of the clasp using a suitable clamping ring without it shifting perpendicular to its surface during operation.

It is universal for all embodiments of the invention that the front side of the clasp remains largely unaffected by the clamping device and represents a free zone which can be arbitrarily configured in order to give the clasp the desired attractive appearance. Arbitrary identifying marks, reliefs or seals can be applied to the front surface. In a few embodiments, it is also possible to arrange the dial actuating the clamping device on the front of the housing freely, whereby the dial can then be configured to improve the appearance of the clasp.

Further details and advantages of the invention can be seen in the following description of embodiments which are represented in the drawings.

DETAILED DESCRIPTION OF THE PREFERRED EMBODIMENTS

Figure 1:
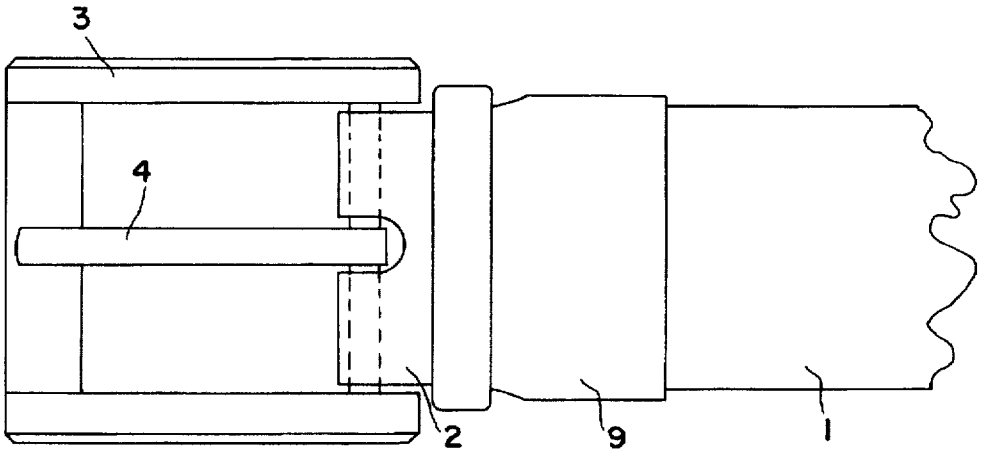
FIG. 1 shows a top plan view of the buckle end of a belt clasp assembly according to one embodiment of the invention.
Figure 2:
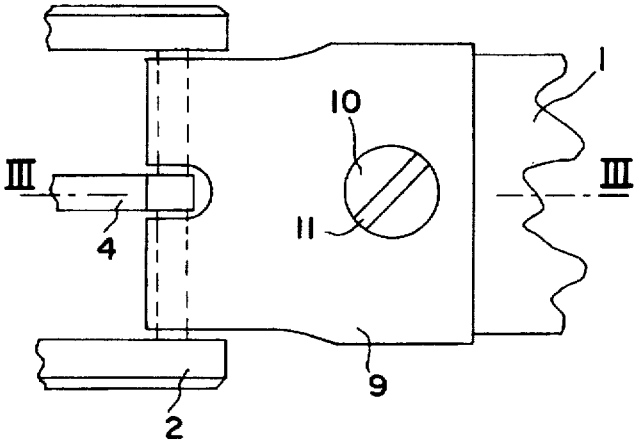
FIG. 2 is a bottom plan view of a portion of the clasp assembly near its rear end.
Figure 3:
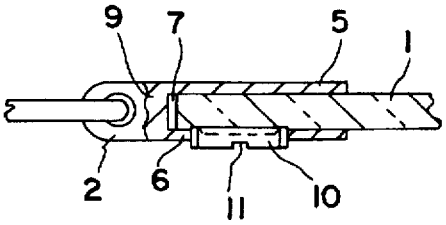
FIG. 3 is a section along line III—III in FIG. 2.

In all embodiments, the belt, only partially shown due to its length, is identified by 1. The belt 1 is fastened at one end to a clasp 2, which can be designed as a conventional buckle 3 with a spoke 4 to lock the other end of the belt into various positions, as shown in FIGS. 1–3. Other belt clasps 2 without the spoke 4 are possible in the scope of the invention, however, which clamp the free end of the belt in arbitrary positions. Such embodiments are shown in FIGS. 4–9.

At least one of the belt ends can be locked at the clasp 2 by clamping using one or more screws. To fasten one end of the belt to the clasp 2, a gap 7 is provided between two opposing walls 5 and 6 in all represented embodiments, into which the end of the belt 1 is inserted and whereat it is clamped solidly by a clamping device 8, described later, consisting of at least one screw, which is supported on one of the two walls 5,6 of the gap 7 and which is shiftable smoothly with respect to the belt 1. The belt 1 is thus pressed against the wall 5,6 of the gap 7 opposite the clamping device 8. The belt end can also be fastened by other means to the clasp in the scope of the invention, for example, in conventional ways by a loop of the belt 1 around a stem of the clasp. The other free end of the belt 1 can also be locked to the clasp 2 with the help of a clamping device instead of with a spoke 4 as shown in FIGS. 1–3. Thus, arbitrary combinations are possible with the embodiment according to the invention.

According to FIGS. 1–3, a connector 9 is provided for fastening one end of the belt. This connector is fastened to the clasp 2 and has two walls 5 and 6 separated from one another by a gap 7 into which the end of the belt 1 is inserted. In this embodiment, a flat, countersinkable screw 10 set into the wall 6 is provided as the clamping device with a control slot 11. If this slot 11 is designed correspondingly wide, the screw 10 can be turned using a regular coin and the belt can be quickly and easily fastened or loosened from the clasp 2. This has the advantage that if the belt is too long, it can be quickly removed from the clasp 2, shortened and again fastened to the clasp 2. The connector 9 is designed with the purpose of at least partially sealing the gap 7 on its sides as well as between the walls 5 and 6 so that it fits the end of the belt 1, protecting it against unintended rotation and lateral shifting relative to the clasp 2.

The clasp 2 in the embodiments according to FIGS. 4–9 have two gaps 7 and 7' for uptake of the belt 1. This is represented simply in the embodiment according to FIG. 4. Locking the belt 1 with the remaining embodiments proceeds the same way, in principle. Only the design of the clamping device varies.

In each, the gap 7 is in the connector 9 and the gap 7' is in the clasp 2 itself. The end of the belt 1 is fastened in gap 7 of connector 9 in the same way as shown in FIGS. 1–3 and explained in the associated description. A small difference exists simply in that the clamping device in the embodiment according to FIGS. 5 and 6, as seen in FIG. 5, consists of two screws 10 and 10'. Another difference arises in that the connector 9 in the embodiments shown in FIGS. 4 and 9 is fixedly connected to the clasp 2, however, in the two examples according to FIGS. 5–8, it is tiltably connected to the clasp 2 by means of a hinge 12.

Figure 4:
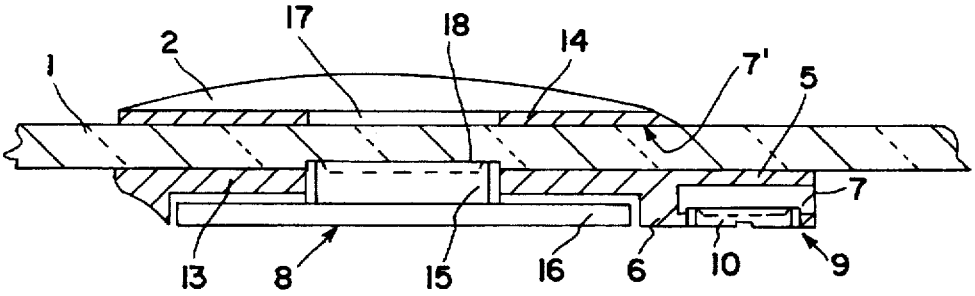
FIG. 4 is a lengthwise section through another embodiment of clasp assembly according to the invention.
Figure 5:
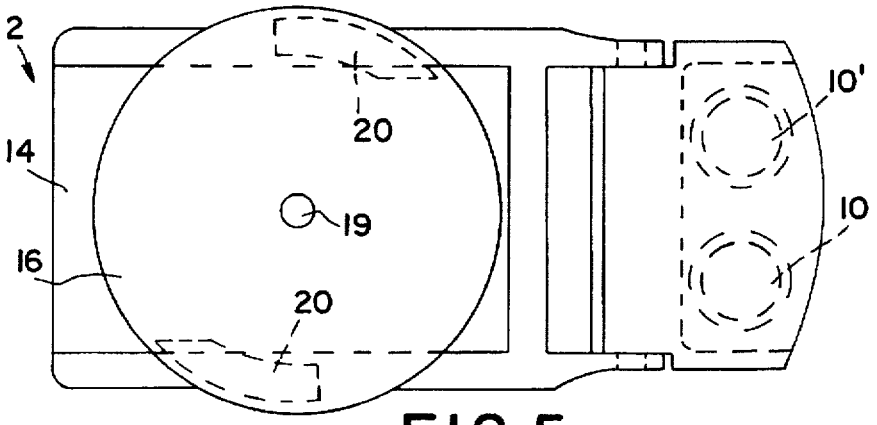
FIG. 5 shows a plan view of another embodiment.

It follows from the embodiments that the gap 7' in the clasp 2 is designed as a penetrating channel in which the free end of the belt 1 can be inserted arbitrarily far (FIG. 4). To fasten the belt 1, a clamping device 8 is screwed into the lower wall 13 in FIG. 4, which presses the belt 1 onto the opposite wall 14 and thus locks it in gap 7'.

In the embodiment according to FIG. 4, the clamping device 8 consists of a simple threaded insert 15, which is screwed into the wall 13 with the help of a dial 16 laterally protruding over the perimeter of the clasp 2 and which can thus be fastened against the belt 1. An opening 17 is located opposite to the threaded insert 15 in the upper wall 14 of the clasp 2, into which the belt 1 can be partially pushed in any case. FIG. 4 also shows that a circular surface 18 protrudes on the front of the threaded insert 15 which runs around the outer edge of the threaded insert 15 and can partially extend into the belt 1 on the bottom. The locking is strengthened by this. Finally, FIG. 4 shows that the outside surface of the clasp 2 is freely visible and can be configured with any desired profiling or other decoration.

Figure 6:
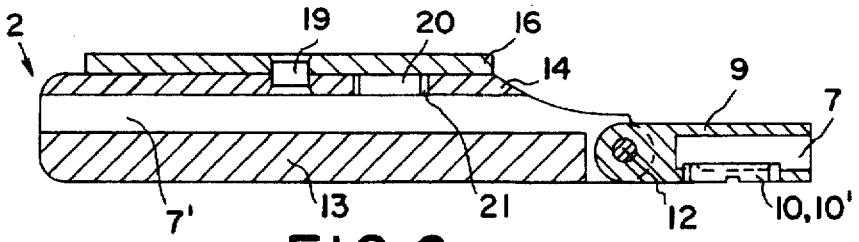
FIG. 6 shows a lengthwise section thereof.

In the embodiment according to FIGS. 5 and 6, one end of the belt (not shown) is fastened with the help of the connector 9 similar to the embodiment according to FIG. 4. The clasp 2 itself again has a gap 7' which is designed as a penetrating channel for the uptake of the free end of the belt. The clamping device consists of a dial 16 in the upper wall 14 rotating about a pin 19, which is provided with a protruding cam 20 at diametrically opposed positions. These cams 20 have a variable cross section so that they act as a wedge of a sloped plane or the like. They can be rotated through openings 21 in the housing wall 14 of the clasp 2 near the gap 7', whereby the belt 1 is fastened against the lower wall 13 of the clasp equally by turning the dial 16.

Figure 7:
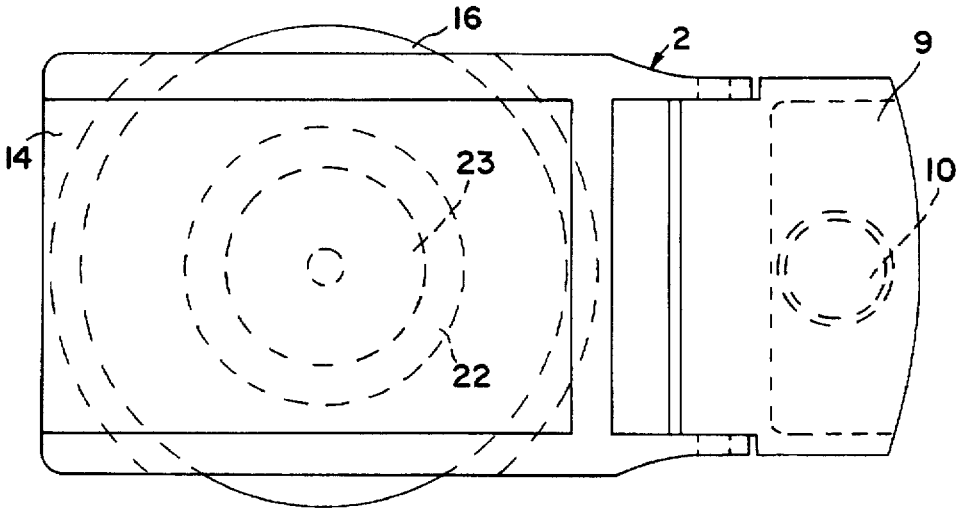
FIGS. 7 and 8 show another embodiment of the invention, FIG. 7 showing a clasp assembly plan view and FIG. 8 showing an axial section through this clasp assembly.
Figure 8:
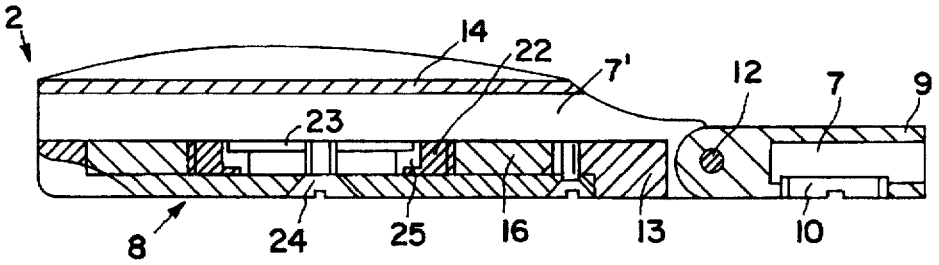
Figure 9:
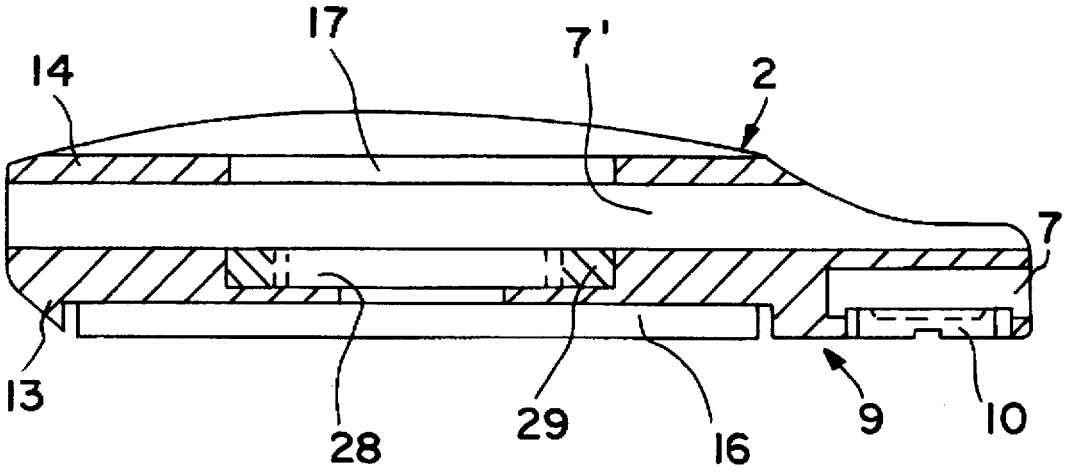
FIG. 9 shows another variation of the clasp assembly in lengthwise section.

Also, in the embodiment according to FIGS. 7 and 8, one end of the belt 1 is fastened by means of a screw 10 in gap 7 of the connector 2, which is hinged to clasp 2. The connector 2 has a gap 7' as a penetrating channel in whose lower wall 13 a clamping device is provided. The clamping device, in this case, is a screw device with a circular dial 16, which protrudes over the housing of the clamp 2 laterally and which has a threading on its inner perimeter into which a pressure ring 22 is screwed. This is fed normal to the gap 7' with its inner edge on a guide ring 23 and is secured against turning. The guide ring 23 is fastened to the housing of the clasp 2 by a screw 24. The entire screw device is housed in a recess of the lower wall 13 of the clasp 2 and is closed with lid 25.

When turning the dial 16, the pressure ring 22 is pressed towards the gap 7', and thus against the belt inserted therein, due to the threaded connection with the dial 16. The belt is clamped against the upper wall 14 of the clasp 2. In all embodiments, the wall surface against which the belt is pressed, can be roughened for improving fastening.

In the example according to FIG. 9, the clasp 2 is constructed similarly to the embodiment represented in FIG. 4. The only difference exists with regard to the clamping device. This is a dial 16 in FIG. 9 which is anchored by and rotates about a threaded shaft 28 in the lower wall 13 of the clasp 2. At its free, broaden end, the threaded shaft 28 has a threading onto which a clamp ring 29 is screwed to secure against turning which can be pressed against the belt 1 inserted into the gap 7', constructed as a penetrating channel, by turning the dial 16 which laterally protrudes over the clasp 2. The free surface on the outside of clamp 2 can also be arbitrarily configured here as well.

I claim:

1. A belt clasp assembly in which a belt having opposite first and second ends can have said first end fastened and which can lock a second end in various positions, said belt clasp assembly comprising a belt clasp, a connector and a clamping means, at least one of said belt clasp and said connector defining a housing having first and second opposing walls providing a gap therebetween, one end of said belt being insertable in said gap, and wherein said clamping means includes a first screw which extends through a first of said opposing walls, a circular dial to operate the screw which protrudes laterally over said housing with an edge and which has a threading on its inner perimeter, a pressure ring screwed within the circular dial which is guided with an inner edge thereof along a guide ring which is non-rotationally but axially displaceable therewithin, wherein the guide ring is fastened to the housing with said first screw, and wherein the pressure ring is displaceable with respect to the belt by turning the dial to clamp the belt between the pressure ring and the second wall.

2. A belt clasp assembly according to claim 1, wherein said clasp defines said housing having first and second opposing walls and wherein said gap envelops said one end of said belt.

3. A belt clasp assembly according to claim 2, wherein said connector is rigidly fastened to said clasp.

4. A belt clasp assembly according to claim 2, including a hinge which rotatably connects said connector to said clasp.

5. A belt clasp assembly according to claim 1, wherein both said clasp and said connector define housings having opposing first and second walls that provide gaps therebetween, wherein said first screw of said clamping means extends through said first wall of said clasp housing, and including a second screw extending through said first wall of said connector housing to fixedly position a portion of a belt in a gap in said connector housing.

6. A belt clasp assembly according to claim 5, wherein said second screw defines a protruding circular surface on a leading portion thereof which can be pressed into the material of the belt.

* * * * *